US005964450A

United States Patent [19]

Pasto

[11] Patent Number: 5,964,450

[45] Date of Patent: Oct. 12, 1999

[54] FLOORING INSTALLATION TOOL

[76] Inventor: Chris E. Pasto, P.O. Box 153, Spencer, N.Y. 14883

[21] Appl. No.: 09/049,668

[22] Filed: Mar. 27, 1998

[51] Int. Cl.[6] ..... B25B 1/20

[52] U.S. Cl. ..... 254/11; 254/13

[58] Field of Search ..... 254/11, 13, 106

[56] References Cited

U.S. PATENT DOCUMENTS

| | | | |
|---|---|---|---|
| 2,710,166 | 6/1955 | Miller | 254/11 |
| 2,849,211 | 8/1958 | Shoesmith | 254/106 |
| 3,136,528 | 6/1964 | Eatough | 254/106 |
| 3,143,335 | 8/1964 | Lassahn | 254/11 |

*Primary Examiner*—David A. Scherbel
*Assistant Examiner*—Daniel G. Shanley
*Attorney, Agent, or Firm*—Brown, Pinnisi & Michaels, P.C.

[57] ABSTRACT

A flooring tool for the installation or repair of wooden tongue and groove flooring. The tool has a jack for exerting linear force, with a fixed and a movable portion. A pivoting gripper is mounted upon the movable portion, and a guide is mounted upon the fixed portion, which allows a brace such as a 2×4 board to be inserted into the guide and gripper and held in place, extending the reach and usefulness of the tool. A foot upon a push-pull rod extends downwards from the fixed portion of the jack, and pushes upon the flooring planks. In a preferred embodiment, two attachment points are provided for the foot on its rod, at each end of the fixed portion, providing maximum flexibility.

18 Claims, 2 Drawing Sheets

FLOORING INSTALLATION TOOL

FIELD OF THE INVENTION

The invention pertains to the field of jack devices useful for floor installation or repair. More particularly, the invention pertains to a jack designed to aid in the repair and installation of wooden flooring by forcing abutting edges of individual pieces of flooring into proper position until they can be fastened into place.

BACKGROUND OF THE INVENTION

Wooden flooring is usually supplied as boards having tongue-and-groove edges, such that the floor is laid over a subfloor by placing the boards next to each other, forcing the tongue on the edge of one board into the mating groove of the next, and nailing the boards in place through the edge, so that the nails are invisible when the next board is installed. Forcing the tongues into the grooves requires a fair amount of force, and the boards must be held tightly together as the nails are driven.

Traditionally the installation and repair of wooden flooring has required two carpenters. To assure a tight fit between the individual pieces of flooring the first carpenter forces the flooring being installed or repaired into proper position, while the second carpenter securely fastens the flooring being held to the subfloor. To insure that the floor is held tightly together it has generally been the situation that nails are driven into the flooring used at an angle so that as the nail engages with the subfloor, the individual pieces of flooring are driven laterally into a tighter abutment with the piece of flooring previously put in place. In this manner the flooring is constructed, one piece at a time, gradually being laid from the base of a starting wall towards the base of an ending wall where the last piece will be put in place.

A number of devices have been developed in the past to aid in the installation of flooring, but they have had a number of deficiencies which make them difficult to use in the modern method of installation on a subfloor.

Examples of these prior art flooring clamps or jacks are Parrish, "FLOOR CLAMP" U.S. Pat. No. 10,061, issued in 1853; Foster, "FLOOR-CLAMPS", U.S. Pat. No. 136,428, issued in 1873; or Lassahn, "CLAMPING DEVICE FOR CONSTRUCTING FLOORING, DECKING AND THE LIKE", issued in 1964. All of these devices force the flooring into alignment using screw (Parrish), rack-and-pinion (Foster) or hydraulic (Lassahn) force exerted against the floor joists. Obviously, this would not work if the floor is being installed in the present manner over a plywood subfloor.

Masters, "PUSH STICK FOR PLUMB AND LINE ADJUSTMENT OF STUD WALLS", U.S. Pat. No. 4,660,806, issued in 1987, is a more general pushing device using a hydraulic ram, but is not used for flooring.

Powernail Co. Inc, P.O Box 300, Lincolnshire, Ill. 60069, currently markets two models of a flooring jack called a Powerjack™. Both use a ratchet mechanism to exert force on flooring. The Powerjack 100 has a bent leg which hooks over the edge of the tongue-in-groove flooring and a flat pressor foot moved by a ratchet. The unit rides on the flooring to be moved, while the pressor foot pushes against a stationary object such as a wall or a stud nailed to the subfloor, thus pulling the flooring into place. The Powerjack 200 is designed for glue down and gym floor installation by pushing from a subfloor anchor point. It has a flat foot which must be attached by nails or screws to the subfloor, and a second foot which can be moved by a ratchet to press against the tongue-in-groove flooring. Both have relatively restricted maximum distances from their anchor points, and, unless used right next to a wall in the case of the model 100, both require some sort of anchor attached to the subfloor.

SUMMARY OF THE INVENTION

The invention comprises a flooring tool for use in installing tongue-in-groove wooden floor in which a jack is used to push a foot against the strips of flooring to be installed, forcing the strips into alignment for nailing.

A pivoting gripper attaches the jack to a board, allowing use of the invention at widely varying distances from a wall, well in excess of the maximum extension of the jack. For use on boards in the middle of the room, the foot is on the opposite end of the jack from the pivoting gripper, allowing maximum extension and distance. For installing the last few boards, the pivoting gripper may be removed or swiveled out of the way, and the foot moved to the other end of the jack, allowing the tool to exert force against boards only inches from the wall.

DESCRIPTION OF THE PREFERRED EMBODIMENT

Figure 1:
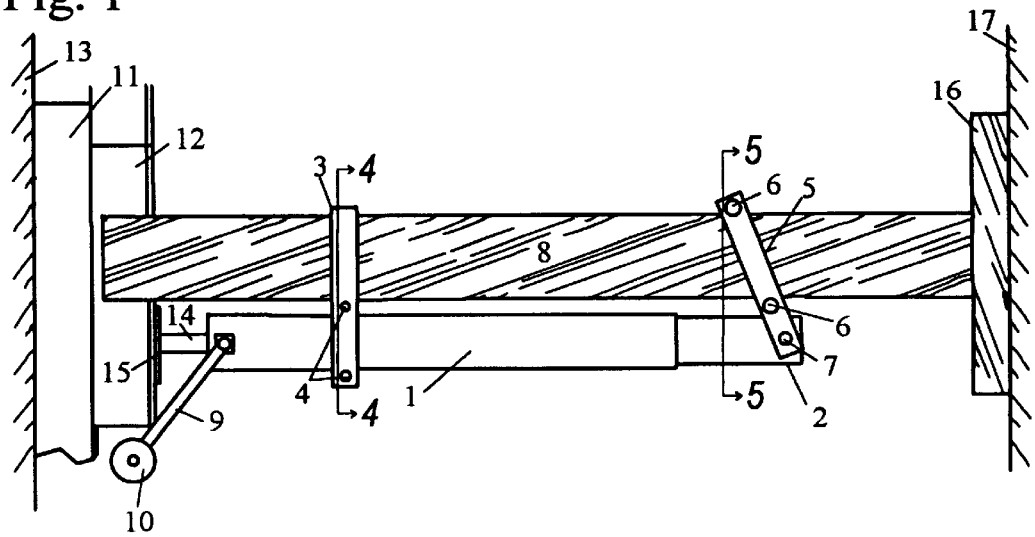
FIG. 1 shows the invention being used to install a wooden tongue and groove floor covering.
Figure 2:
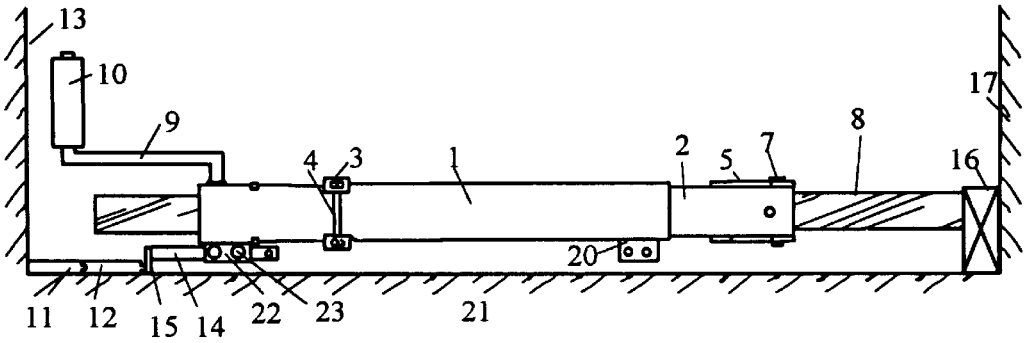
FIG. 2 shows a side view of the invention, corresponding to FIG. 1.

FIGS. 1 and 2 show the invention in use. The floor jack of the invention uses a jack to exert force, which comprises a movable portion (2) and a fixed portion (1). It will be understood that "fixed portion" and "movable portion" are terms which are adopted herein for convenience, and that, in fact, both sections are movable relative to each other. The fixed portion houses an actuating mechanism such as a worm gear or rack-and-pinion actuated by a crank (9) and handle (10). If desired, the crank (9) and handle (10) can be replaced by a standard ¼, ⅜, or ½ inch drive socket, so that a conventional socket wrench drive could be used as the handle, or by a hex head suitable for actuation by a socket wrench with socket. Alternatively, the fixed portion could contain a hydraulic or pneumatic cylinder driven by a lever or pump, or an electric motor, depending on the form of the jack. Turning the crank (9), or whatever actuation is appropriate for hydraulic or pneumatic jacks, causes the movable portion (2) of the jack to be extended, exerting an outward force.

A conventional trailer jack (that is, a jack which is used to support trailer tongues when the trailer is detached from the towing vehicle) is an appropriate jack for use with the invention. By removal of the swivel wheel or jack plate and addition of the fittings described below, the trailer jack mechanism can form the basis of a flooring jack according to the teachings of the invention. Such jacks are available from a number of manufacturers, in mechanical, electric, pneumatic or hydraulic forms.

The JP214S0317 trailer jack manufactured by Fulton Performance Products of Mosinee, Wis., for example, can provide up to 2000 pounds of force and up to 14 inches of extension. Other models in the Magnum series by the same manufacturer can apply up to 7,000 pounds of force, and still other models have maximum extensions of 27 inches or more.

Some mechanical jacks have the additional benefit that they can exert a force both in extension and retraction, which a hydraulic, pneumatic, or ratchet-type jack could not do. Under some circumstances, this would add to the flexibility of use of the invention.

Two tabs (20) and (22) are attached to opposite ends of the fixed portion (1) of the jack, allowing the pressure foot (15) on push/pull rod (14) to be attached to either end of the jack, for reasons to be explained below. This multiple mounting allows great flexibility in the configuration of the flooring jack of the invention. If desired, a third tab could be added to the movable portion (2) of the jack, and a second foot and rod attached there.

Figure 4:
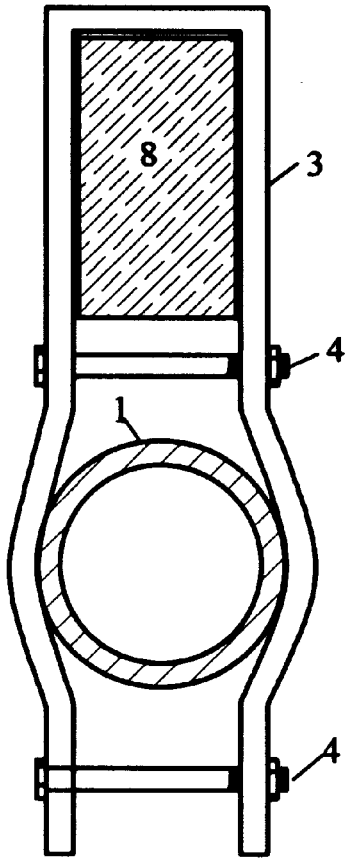
FIG. 4 shows an end view of the jack of the invention, at the location of the fixed guide, along lines 4—4 in FIG. 1.

Also attached to the fixed portion (1) of the jack is a fixed guide (3). FIG. 4 is an end view of the jack, showing how the guide (3) is attached to the fixed portion (1) by bolts (4) clamping the guide (3) around the jack. There is sufficient space within the generally U-shaped guide (3), above the upper bolt (4) to allow a board (8), preferably a "2×4" (conventionally 1½ by 3½), to be inserted.

Figure 5:
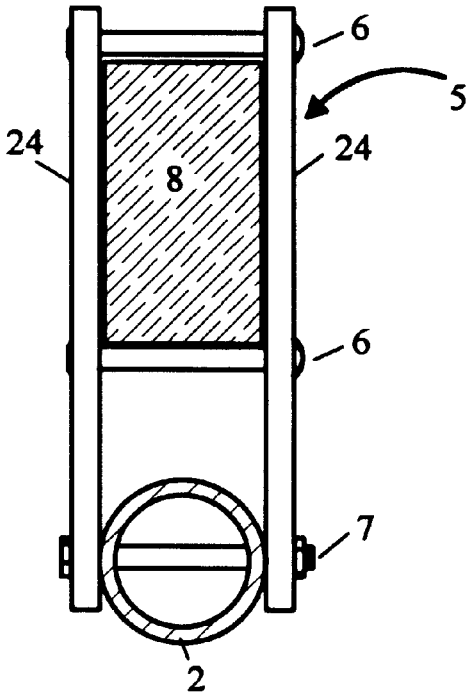
FIG. 5 shows an end view of the jack of the invention, at the location of the pivoting gripper, along lines 5—5 in FIG. 1.

A pivoting gripper (5) is attached to the movable end (2) of the jack. FIG. 5 shows a detail of the gripper (5). The gripper (5) is pivotally mounted to the movable end (2), and has a pair of gripping elements (6) for holding the board or brace (8). As can be seen in that figure, the gripper (5) can be made of two plates (24) joined by welded-in pins (6), as shown, or by bars or bolts. Alternatively, the gripper could be made in a U-shape as shown for the guide, and only a single pin (6) used as the second gripping element. The pins (6) are spaced apart sufficiently to allow a board (8), preferably a 2×4, to fit between the pins (6). The gripper (5) is free to pivot around pivot bolt (7), passing through the movable end (2) of the jack. By pivoting the gripper (5), the board (8) will be gripped between the pins (6). The pins may be cylindrical in cross-section, or square, rectangular, hexagonal, oval or any other shape desired.

Referring to FIGS. 1 and 2, the invention can be seen in use. One row of tongue-in-groove flooring (11) has been installed next to a wall (13). A second row of flooring (12) is placed next to the first row (11), and must be forced tightly against the first row, to cause the tongue to fit tightly and fully into the groove, so that the row (12) can be nailed in place.

The foot (15) on its push/pull rod (14), attached to tab (22) on the end of the fixed portion (1) furthest from the movable portion (2) to gain maximum extension, is placed in contact with the row of boards (12) to be forced into place. If the distance between the foot (15) and the end of the movable portion (2) is not enough to allow the movable portion (2) to reach the far wall (17), a long board (8), preferably a 2×4 or the like, is placed through the fixed guide (3) and the pivoting gripper (5), with its far end pressing against the far wall (17). If desired, a facing board (16) between the board (8) and the wall (17) can provide protection from marring the wall (17).

The gripper (5) is pivoted to grip the board (8), and the actuator (here crank (9) and handle (10)) is actuated to cause the movable portion (2) to extend, exerting force between the wall (17) and the foot (15), forcing the flooring (12) into place. With the flooring (12) held in place, nails can then be driven in conventional fashion.

With an 8 foot long 2×4, and a jack with 24" extension, the jack of the invention can thus be used across a room of nearly 10 feet in width. A ten- or twelve-foot board would allow use in even wider rooms, or a temporary brace could be installed on the floor to allow use of the tool over arbitrary distances.

Figure 3:
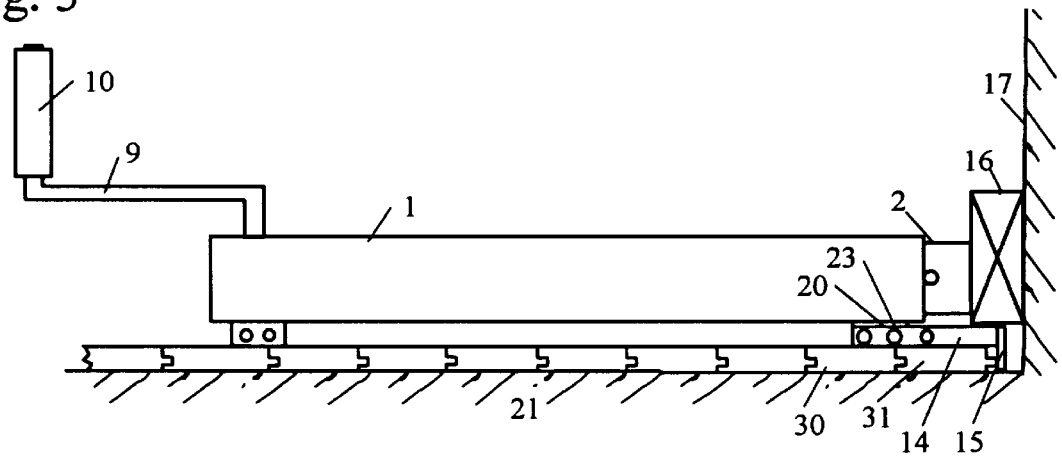
FIG. 3 shows the invention, configured for use with boards close to a wall.

As shown in FIG. 3, as the floor nears completion, the board (8) could be omitted and the movable portion (2) could press directly against the wall (17), perhaps with a facing board (16) between the wall (17) and the movable portion (2). By moving the foot (15) to the tab (20) on the end of the fixed portion (1) closest to the movable portion (2), the jack of the invention can be used up to the last few rows of flooring (30) and (31), right up against the wall (17).

The ability to move the foot (15) from tab (22) at one end of the fixed portion (1) to tab (20) at the other, and to reverse the foot (15) on its push/pull rod (14), plus the ability to use a 2×4 to extend the reach of the jack, gives the invention a flexibility of use unmatched in the prior art.

A single jack can thus be used to press every row of tongue-in-groove flooring into place right across a room. For the first rows of flooring (12) near wall (13), the jack is used at maximum extension, with the end of the board (8) near guide (3), and with the foot on tab (22). As the flooring progresses across the floor, the board (8) can be slid through guide (3), with gripper (5) progressively loosened and tightened. Within two or three feet of the far wall (17), the board can be dispensed with and the movable portion (2) placed against the wall. Alternatively, if a tab is provided on the movable portion, a foot and push/pull rod can be attached to the tab and the foot pressed against the wall (17). Finally, for the last few boards (30), (31), the foot (15) and push/pull rod (14) are reversed and moved to tab (20).

Although the invention has been described herein primarily as a flooring installation tool, it will be understood that the flexible arrangement of the invention allows its use in other applications, as well. With the board (8) vertically arranged, the foot (15) could be mounted to either tab (20) or (22), as needed, and used to support horizontal sheets of wallboard or paneling while they are screwed to studs.

Accordingly, it is to be understood that the embodiments of the invention herein described are merely illustrative of the application of the principles of the invention. References herein to details of the illustrated embodiments are not intended to limit the scope of the claims, which themselves recite those features regarded as essential to the invention.

What is claimed is:

1. A flooring installation tool comprising:

a) a jack comprising a fixed portion, a movable portion, and an actuator, such that when the actuator is actuated, a linear force is exerted between the fixed portion and movable portion, b) a pivoting gripper pivotally attached to the movable portion, having a pivot point attached to the movable portion and first and second plates pivotally attached to opposite sides of the movable portion, and first and second gripping elements, the gripping elements being spaced apart a sufficient distance and having a sufficient length to permit a brace to be inserted therebetween, such that when the pivoting gripper is pivoted about the pivot point, the brace is gripped between the gripping elements;

d) at least one attachment point located on the fixed portion;

e) at least one foot for exerting pressure, mounted to at least one attachment point; and f) a guide mounted to the fixed portion in alignment with the pivoting gripper attached to the movable portion, having a size sufficient to allow the brace gripped by the gripper to slidably pass through the guide:

such that when the actuator of the jack is actuated, with the movable portion braced against a fixed point, a linear force is exerted upon the foot.

2. The flooring tool of claim 1, in which at least one foot is detachably mounted to the attachment point, and further comprising at least one additional mounting point at a differing location along the fixed portion, such that the foot may be detached and attached at different points along the fixed portion.

3. The flooring tool of claim 1, in which the jack is a trailer-tongue jack.

4. The flooring tool of claim 1, in which the jack is mechanical.

5. The flooring tool of claim 4, in which the jack is of the worm-gear type.

6. The flooring tool of claim 4, in which the jack is of the rack-and-pinion type.

7. The flooring tool of claim 1, in which the jack is hydraulic.

8. The flooring tool of claim 1, in which the jack is pneumatic.

9. The flooring tool of claim 1, in which the jack is electric.

10. The flooring tool of claim 1, in which the first and second gripping elements are of a form selected from the group comprising cylindrical, square, hexagonal, rectangular and oval.

11. The flooring tool of claim 10, in which the gripping elements are bolts.

12. The flooring tool of claim 10, in which the gripping elements are pins.

13. The flooring tool of claim 1, further comprising an elongated brace, having cross-sectional dimensions such that the brace can slidably fit through the pivoting gripper when the gripper is perpendicular to the movable portion, and can be gripped by the pivoting gripper when the gripper is pivoted out of a perpendicular orientation.

14. The flooring tool of claim 13, in which the brace is a standard 2×4 board.

15. The flooring tool of claim 1, further comprising a push/pull rod having the foot mounted upon an end and adapted to be attached to the attachment point at another end.

16. The flooring tool of claim 1, in which the dimension of the guide is adjustable, such that braces having differing dimensions may pass through and be gripped by the gripper.

17. The flooring tool of claim 1, in which the dimension of the gripper is adjustable, such that braces having differing dimensions may be gripped by the gripper.

18. The flooring tool of claim 1, further comprising at least one attachment point on the movable portion.

* * * * *